US005271998A

United States Patent [19]

Duckett

[11] Patent Number: 5,271,998

[45] Date of Patent: Dec. 21, 1993

[54] LIGHTWEIGHT METALIZED FABRIC

[75] Inventor: Charles W. Duckett, Kernersville, N.C.

[73] Assignee: Precision Fabrics Group, Inc., Greensboro, N.C.

[21] Appl. No.: 893,829

[22] Filed: Jun. 4, 1992

[51] Int. Cl.[5] ..... B05D 3/12; B32B 15/08; B32B 15/14; B32B 33/00; C23C 16/56

[52] U.S. Cl. ..... 428/251; 427/250; 427/369; 427/370; 427/404; 428/907

[58] Field of Search ..... 427/250, 369, 370, 404; 428/251, 907

[56] References Cited

PUBLICATIONS

*Chemical Abstracts* 97(12):93874.

*Chemical Abstracts* 77(6):36331.

*Primary Examiner*—James C. Cannon

*Attorney, Agent, or Firm*—Finnegan, Henderson, Farabow, Garrett & Dunner

[57] ABSTRACT

A fabric suitable for an automobile cover includes a metalized fabric having a finish coating including an emulsion of urethane polymers, acrylic polymers and a fluorocarbon. The finish coating may also include an antimicrobial agent, a surfactant and a catalyst. Such a fabric can be manufactured by vacuum metalizing a fabric with aluminum, applying a finishing solution of urethane, acrylic, fluorocarbon emulsion, drying the fabric at a temperature between 320° F. and 400° F., and calendering the fabric.

23 Claims, 1 Drawing Sheet

LIGHTWEIGHT METALIZED FABRIC

BACKGROUND OF THE INVENTION

The present invention relates to a metalized, water resistant fabric and method of manufacturing the same.

2. Description of the Related Art

A fabric which can be used for a cover or other like purpose is desirably water repellant, mildew resistant, wash durable, light stable and non-tacky. Presently, fabrics are customarily dyed and finished to produce water repellant fabric suitable for automobile covers.

Specifically, automobile covers may be produced by various materials such as dyed and finished woven fabrics, dyed and finished non-woven fabrics, dyed and finished knit fabrics, composite lamination of non-woven fabrics, composite lamination of woven fabrics, composite lamination of knit fabrics, and composite lamination of woven, knit or non-woven fabrics in combination. The same types of fabrics are applicable to covers for other uses such as boats, trucks, tractors, and outdoor furniture and grills.

It is common for the dyed and finished fabrics used for these types of covers to contain water repellant compounds such as fluorocarbon polymers, wax emulsions, hydrophobic thermosetting resins, silicon emulsions and mixtures thereof. Because of the chemical nature of these compounds, wash durability, light stability and ability to protect a metalized fabric has not been achieved. Furthermore, these covers do not exhibit desirable Characteristics of light weight, thinness, slickness, softness, flexibility and breathability. It is desirable to combine all of these features in a fabric for an automobile cover or like application.

SUMMARY OF THE INVENTION

The objects of the invention are to produce a fabric having the desirable qualities listed above, as well as the method of manufacturing such a fabric.

Additional objects and advantages of the invention will be set forth in part in the description which follows, and in part will be obvious from the description or may be learned by practice of the invention. The objects and advantages of the invention will be realized and attained by way of the elements and combinations particularly pointed out in the appended claims.

To achieve the objects and in accordance with the purposes of the invention, as embodied and broadly described herein, the invention comprises a metalized fabric including a finish coating comprising an emulsion of urethane, acrylic and fluorocarbon polymers. As preferably embodied herein, the finish coating further comprises an antimicrobial agent, a surfactant and a catalyst. The fabric is preferably a woven nylon fabric having a rip stopweave.

Further to achieve the objects and in accordance with the purposes of the invention, as embodied and broadly described herein, the invention comprises a method of vacuum metalizing a fabric with aluminum, applying a finishing solution comprising a urethane, acrylic, fluorocarbon polymer emulsion, and drying the fabric at a temperature between 320° F. and 400° F. As preferably embodied herein, the method of manufacturing further includes a step of calendering the fabric after drying where the calendering occurs at a pressure between 1000 and 3000 psi and at a temperature of between 60° F. and 500° F. The fabric is preferably fed during calendering at a speed of 5 to 60 yards per minute.

It is to be understood that both the foregoing general description and the following detailed description are exemplary and explanatory only, and are not restrictive of the invention, as claimed.

BRIEF DESCRIPTION OF THE DRAWING

The accompanying drawing, which is incorporated herein and constitutes a part of the specification, illustrates one embodiment of the invention and together with the description, serves to explain the principles of the invention.

DESCRIPTION OF THE PREFERRED EMBODIMENT

Figure 1:
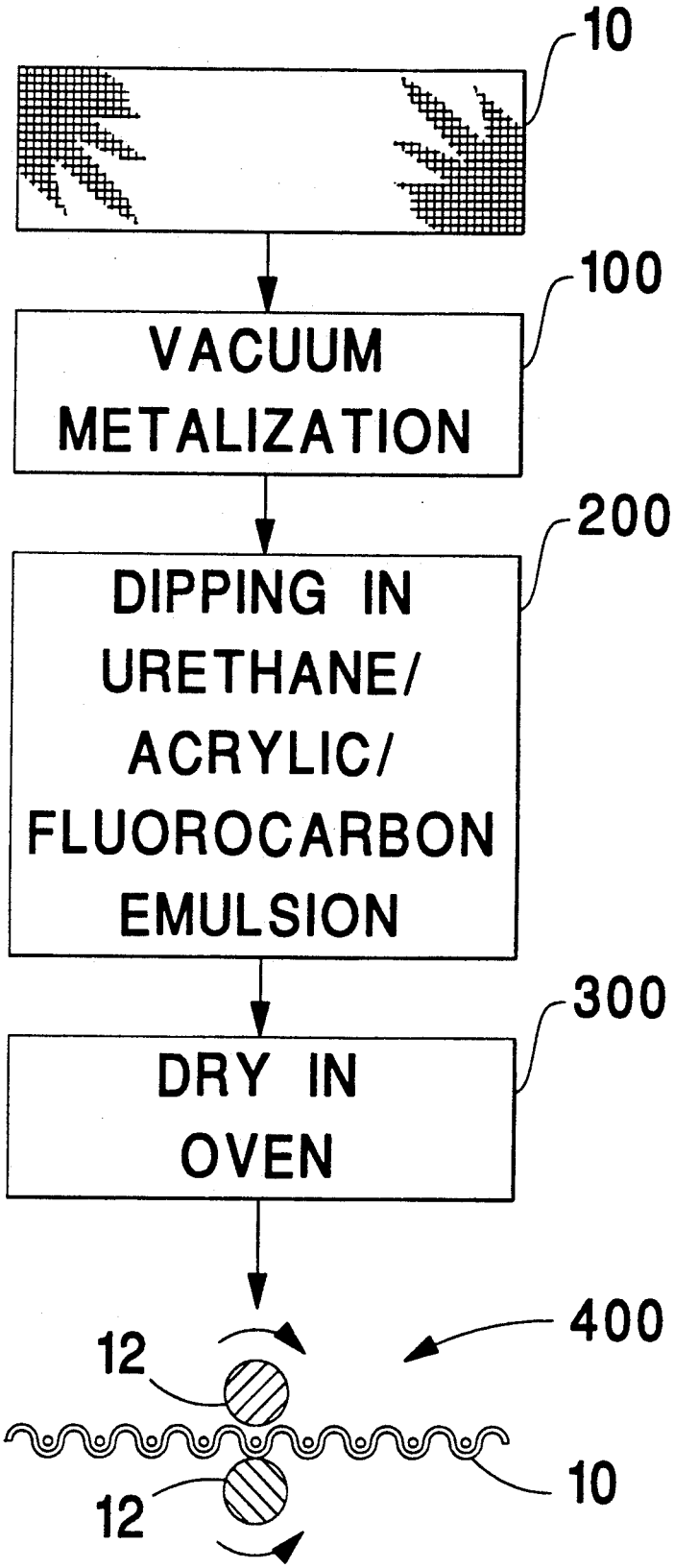
FIG. 1 is a schematic diagram of the method of manufacturing a fabric according to the invention.

Reference will now be made to the presently preferred embodiment of the invention, an example of which is illustrated in the accompanying drawing. Wherever, possible, the same reference numerals will be used throughout the drawings to refer to the same or like parts.

As shown in FIG. 1, the method of manufacturing a metalized fabric according to the invention includes the step 100 of metalizing a fabric 10. The fabric is preferably a woven nylon fabric having a plain weave ripstop pattern. Other weaves, such as twill, satin and crepe, may be used. Preferably, the fabric yarns range from 30 to 70 denier in the warp and fill directions. Further preferably a DuPont ® Nylon T-335 yarn is used. Prior to metalizing, the fabric is preferably scoured clean and dried.

At this point, the fabric is vacuum metalized, preferably with aluminum. This process includes applying a very thin layer of aluminum to the surface of the nylon fabric with a technique known to those of ordinary skill in the art of metalizing fabrics and film. This metalizing process is available from various vendors, including Diversified Fabrics of Kings Mountain, N.C. and National Metalizing of Cranberry, N.J.

The method of manufacturing a metalized fabric, according to the invention, further includes the step of applying a finishing solution to the metalized fabric comprising a urethane, acrylic, fluorocarbon polymer emulsion. An antimicrobial agent, a surfactant, a catalyst, and any mixture thereof may also be added. Table 1 lists, as an example, various components of the finish composition, their weight percentage in the finish coating, and examples of the suppliers and tradenames of sources for the finish components, which are combined to form an aqueous emulsion.

TABLE 1

| COMPONENT | % BY WEIGHT | TRADE NAME | SUPPLIERS |
|---|---|---|---|
| URETHANE | 1-50% | UE 40-350 | PERMUTHANE |
| | | WITCOBOND W-290H | WITCO |
| ACRYLIC | 1-50% | HYSTRETCH V43HX | B.F. GOODRICH |
| | | RHOPLEX TR-934 | ROHM & HAAS |
| FLUOROCARBON | 1-10% | TEFLON 7040 | DUPONT |

TABLE 1-continued

| COMPONENT | % BY WEIGHT | TRADE NAME | SUPPLIERS |
|---|---|---|---|
| | | SCOTCHGARD FC 214-30 | 3M |
| SURFACTANT | 0-10% | DEXOPAL 555 | DEXTER CHEMICAL |
| | | ISOPROPANOL | ASHLAND CHEMICAL |
| CATALYST | 0-10% | ACCELERATOR UTX | AMERICAN CYANAMID |
| | | AMMONIUM SULFATE | ASHLAND CHEMICAL |
| ANTIMICROBIAL | 0-10% | DC 5700 | DOW CORNING |
| WATER | 0-80% | — | — |

The metalized fabric is pad dipped (step 200) into the finish composition and then dried (step 300) in a tenter frame oven. The drying process is preferably carried out at approximately 320° F. to 400° F. for approximately twenty to sixty seconds.

After finishing, the fabric may be optionally subject to calendering (step 400) to achieve a desired surface finish and a more flexible fabric. The calendering involves processing the metalized fabric 10 through pressurized contact rollers 12 at speeds which preferably range from 5 to 60 yards per minutes, depending upon the calendering equipment. The calendering pressure is preferably between 1000 and 3000 psi and the calendering temperature may range from room temperature (e.g., 60° F.) to 500° F. The calendered fabric results in a very smooth, flat fabric with a low air porosity and a higher water repellency than an uncalendered fabric.

EXAMPLE

A preferred embodiment of the invention includes a fabric of woven nylon constructed of thirty denier/ten filament yarn in the warp and filling direction. The fabric has a ripstop weave with a round count of 232 and a greige weight of 0.96 ounces per square yard.

The fabric was scoured clean and dried, and then vacuum metalized with aluminum. The vacuum metalized fabric was dipped at room temperature in a finish composition of 5% by weight urethane emulsion, 15% by weight acrylic emulsion, 7.5% by weight fluorocarbon emulsion, 1.0% by weight surfactant agent, 0.5% by weight antimicrobial agent and 71% by weight water. After dipping, the fabric was dried at 360° F. for 30 seconds in a tenter frame oven.

Finally, the fabric was calendered at a temperature of 400° F. at 20 yards/minute using a three roll calender consisting of two still rolls and one fiber filled roll set at a pressure of 1950 psi.

A fabric prepared by this preferred method exhibits highly desirable characteristics for an automobile cover, and is useful in a retractable automobile cover as disclosed in U.S. Pat. No. 4,764,998 for Retractable Cover, issued on Aug. 23, 1988 to Norris et al., the disclosure of which is incorporated herein by reference.

It will be apparent to those skilled in the art that various modifications and variations can be made in the fabric of the present invention and in construction of this fabric without departing from the scope or spirit of the invention. It will also be apparent to those of ordinary skill in the art that the fabric of the invention will be useful in many other applications, including covers for objects other than automobiles, such as boats, trucks, tractors, outdoor furniture and grills.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A metalized fabric including a finish coating comprising an emulsion of urethane, acrylic and fluorocarbon polymers.

2. A metalized fabric according to claim 1, wherein the finish coating further comprises an antimicrobial agent.

3. A metalized fabric according to claim 1, wherein the finish coating further comprises a surfactant.

4. A metalized fabric according to claim 1, wherein the finish coating further comprises a catalyst.

5. A metalized fabric according to claim 1, further comprising a woven nylon fabric.

6. A metalized fabric according to claim 5, wherein the nylon fabric has a ripstop weave.

7. A metalized fabric according to claim 5, further including an elastic edge and wherein the fabric is tailored to fit over an automobile.

8. The metalized fabric as claimed in claim 1, wherein the emulsion comprises 1 to 50 wt% of an urethane polymer 1 to 50 wt % of an acrylic polymer, 1 to 10 wt % of a fluorocarbon, 0 to 10 wt % of a surfactant, 0 to 10 wt % of a catalyst, and 0 to 10 wt % of an antimicrobial agent, the remainder being water.

9. The metalized fabric as claimed in claim 8 wherein the emulsion comprises 5 wt % of urethane polymer, 15 wt % of acrylic polymer, 7.5 wt % of fluorocarbon polymer, 1.0 wt % of surfactant, 0.5 wt % of antimicrobial agent and 71 wt % of water.

10. The metalized fabric of claim 1 wherein the fabric includes yarns ranging from 30 to 70 denier in both the warp and fill directions.

11. The metalized fabric of claim 10, wherein the fabric has a round count of 232 and a greige weight of 0.96 ounces/sq. yd., and wherein the yarn is 30 denier/10 filament in both the warp and fill directions.

12. A method of manufacturing a metalized fabric comprising the steps of:

vacuum metalizing a fabric with aluminum;

applying a finishing emulsion comprising a urethane polymer, acrylic polymer, fluorocarbon emulsion; and drying the fabric at a temperature between 320° F. and 400° F.

13. The method according to claim 12, further comprising the steps of calendering the fabric after drying.

14. The method according to claim 12, wherein the calendering step subjects the fabric to 1000 psi to 3000 psi of pressure at a temperature between 60° F. and 500° F.

15. The method according to claim 14, wherein the step of calendering includes the substep of feeding the fabric at a speed of 5-60 yards per minute.

16. The method according to claim 12, wherein the applying step applies an emulsion comprising 1 to 50 wt % of a urethane polymer, 1 to 50 wt % of an acrylic polymer, 1 to 10 wt % of a fluorocarbon, 0 to 10 wt % of a surfactant, 0 to 10 wt % of a catalyst, and 0 to 10 wt % of an antimicrobial agent, the remainder being water.

17. The method according to claim 16, wherein the applying step applies an emulsion comprising 5 wt % of urethane polymer, 15 wt % of acrylic polymer, 7.5 wt % of fluorocarbon, 1.0 wt % of surfactant, 0.5 wt % of antimicrobial agent and 71 wt % of water.

18. A fabric made according to the method of claim 17.

19. A fabric made according to the method of claim 16.

20. A fabric made according to the method of claim 15.

21. A fabric made according to the method of claim 14.

22. A fabric made according to the method of claim 13.

23. A fabric made according to the method of claim 12.

* * * * *